US009816246B2

(12) United States Patent
Reinhall et al.

(10) Patent No.: US 9,816,246 B2
(45) Date of Patent: Nov. 14, 2017

(54) PILE WITH SOUND ABATEMENT FOR VIBRATORY INSTALLATIONS

(71) Applicant: University of Washington through its Center for Commercialization, Seattle, WA (US)

(72) Inventors: Per G. Reinhall, Seattle, WA (US); John Timothy Dardis, II, Seattle, WA (US)

(73) Assignee: University of Washington Through its Center for Commercialization, Seattle, WA (US)

( * ) Notice: Subject to any disclaimer, the term of this patent is extended or adjusted under 35 U.S.C. 154(b) by 64 days.

(21) Appl. No.: 14/864,762

(22) Filed: Sep. 24, 2015

(65) Prior Publication Data

US 2016/0010306 A1 Jan. 14, 2016

Related U.S. Application Data

(63) Continuation-in-part of application No. 14/148,720, filed on Jan. 6, 2014, which is a continuation-in-part
(Continued)

(51) Int. Cl.
*E02D 13/00* (2006.01)
*E02D 11/00* (2006.01)
(Continued)

(52) U.S. Cl.
CPC ..... *E02D 13/005* (2013.01); *E02D 5/72* (2013.01); *E02D 7/02* (2013.01)

(58) Field of Classification Search
CPC ..... E02D 13/005; E02D 5/72
(Continued)

(56) References Cited

U.S. PATENT DOCUMENTS 790,910 A 5/1905 McClintock
2,972,871 A 2/1961 Foley
(Continued)

FOREIGN PATENT DOCUMENTS

KR 10-0543727 B1 1/2006
KR 10-0657176 B1 12/2006
(Continued)

OTHER PUBLICATIONS

International Search Report and Written Opinion dated Aug. 3, 2011, issued in corresponding International Application No. PCT/US2011/021723, filed Jan. 19, 2011, 7 pages.

*Primary Examiner* — Tara M. Pinnock
(74) *Attorney, Agent, or Firm* — Christensen O'Connor Johnson Kindness PLLC

(57) ABSTRACT

A noise-attenuating pile comprising a pile driving shoe, an outer tube that engages the pile driving shoe, and an inner member that extends through the outer tube and engages the pile driving shoe, wherein the pile is configured to be installed in the ground with either an impact driver or a vibratory driver that engages only the inner member. The inner member is rigidly connected to the driving shoe, and the outer tube is elastically connected to the driving shoe, such that vibrations from the outer tube is substantially isolated from vibrations in the driving shoe.

14 Claims, 14 Drawing Sheets

Related U.S. Application Data of application No. 13/574,231, filed as application No. PCT/US2011/021723 on Jan. 19, 2011, now Pat. No. 8,622,658.

(60) Provisional application No. 62/055,546, filed on Sep. 25, 2014, provisional application No. 61/296,413, filed on Jan. 19, 2010, provisional application No. 61/876,101, filed on Sep. 10, 2013.

(51) Int. Cl.
*E02D 7/02* (2006.01)
*E02D 5/72* (2006.01)

(58) Field of Classification Search
USPC ..... 405/227, 228, 231, 232, 255, 256, 257
See application file for complete search history.

(56) References Cited

U.S. PATENT DOCUMENTS

| | | | | |
|---|---|---|---|---|
| 3,261,412 | A | | 7/1966 | Lob |
| 3,559,410 | A | * | 2/1971 | Blenkarn et al. ... B63B 35/4413 175/7 |
| 3,645,345 | A | * | 2/1972 | Olsen ..... E02D 5/72 175/103 |
| 3,779,025 | A | | 12/1973 | Godley et al. |
| 3,932,999 | A | | 1/1976 | Todd |
| 4,808,037 | A | | 2/1989 | Wade |
| 4,817,734 | A | | 4/1989 | Kuehn |
| 5,282,701 | A | | 2/1994 | An |
| 5,320,453 | A | | 6/1994 | Bullivant |
| 5,494,378 | A | | 2/1996 | Hanson |
| 6,042,304 | A | | 3/2000 | Manning |
| 6,047,505 | A | | 4/2000 | Willow |
| 6,123,485 | A | | 9/2000 | Mirmiran et al. |
| 6,264,403 | B1 | | 7/2001 | Hall et al. |
| 6,354,766 | B1 | | 3/2002 | Fox |
| 6,409,433 | B1 | | 6/2002 | Hubbell et al. |
| 6,427,402 | B1 | | 8/2002 | White |
| 6,568,881 | B2 | | 5/2003 | Long |
| 7,037,045 | B2 | | 5/2006 | Jones |
| 7,226,247 | B2 | | 6/2007 | Barrett et al. |
| 7,338,233 | B2 | | 3/2008 | Barrett et al. |
| 7,476,056 | B2 | | 1/2009 | Dreyer |
| 7,517,174 | B2 | | 4/2009 | Wolynski et al. |
| 7,556,453 | B2 | | 7/2009 | Collina et al. |
| 8,622,658 | B2 | | 1/2014 | Reinhall et al. |
| 2002/0159843 | A1 | | 10/2002 | Hubbell et al. |
| 2003/0082012 | A1 | | 5/2003 | Clark |
| 2007/0065233 | A1 | | 3/2007 | Collina |
| 2008/0006478 | A1 | | 1/2008 | Dreyer |
| 2009/0110488 | A1 | | 4/2009 | Pearson |
| 2009/0129871 | A1 | | 5/2009 | Mohr |
| 2013/0011203 | A1 | | 1/2013 | Reinhall et al. |
| 2014/0086693 | A1 | | 3/2014 | Reinhall et al. |

FOREIGN PATENT DOCUMENTS

| | | | |
|---|---|---|---|
| KR | 10-0841735 | B1 | 6/2008 |
| WO | 2004053237 | A1 | 6/2004 |

* cited by examiner

PILE WITH SOUND ABATEMENT FOR VIBRATORY INSTALLATIONS

CROSS-REFERENCES TO RELATED APPLICATIONS

This application claims the benefit of Provisional Application No. 62/055,546, filed Sep. 25, 2014. This application also is a continuation-in-part of application Ser. No. 14/148,720, filed Jan. 6, 2014, which claims the benefit of Provisional Application No. 61/876,101, filed Sep. 10, 2013, and which is a continuation-in-part of application Ser. No. 13/574,231, filed Jul. 19, 2012 (now U.S. Pat. No. 8,622,658), which is a U.S. National Stage of PCT/US2011/021723, filed Jan. 19, 2011, which claims the benefit of Provisional Application No. 61/296,413, filed Jan. 19, 2010. The entire disclosures of said applications are hereby incorporated by reference herein.

BACKGROUND

Impact pile driving in water produces extremely high sound levels in the surrounding environment in air and underwater. For example, underwater sound levels as high as 220 dB re 1 μPa are not uncommon ten meters away from a steel pile as it is driven into the sediment with an impact hammer. Vibratory pile drivers, sometimes referred to as vibratory hammers, are also known in the art. Vibratory installation of piles produces lower peak acoustic pressure in the water but total energy of the radiated noise is still very high. A conventional vibratory pile driver is clamped onto the upper end of a pile that is to be driven into the sediment, and may be positioned and supported over the pile with a crane or the like. The vibratory pile driver generates relatively high frequency vertical impulses to the pile, which loosens or liquefies the sediment that engages the distal end of the pile, such that the weight of the pile (and the vibratory driver) urge the pile into the sediment.

Reported impacts on wildlife around a construction site include fish mortality associated with barotrauma, hearing impacts in both fish and marine mammals, and bird habitat disturbance. Pile driving in water is therefore a highly regulated construction process and can only be undertaken at certain time periods during the year. The regulations are now strict enough that they can severely delay or prevent major construction projects.

There is thus significant interest in reducing underwater noise from pile driving either by attenuating the radiated noise or by decreasing noise radiation from the pile. As a first step in this process it is necessary to understand the dynamics of the pile and the coupling with the water as the pile is driven into sediment. The process is a highly transient one in that every strike of the pile driving hammer on the pile causes the propagation of deformation waves down the pile. To gain an understanding of the sound generating mechanism the present inventors have conducted a detailed transient wave propagation analysis of a submerged pile using finite element techniques. The conclusions drawn from the simulation are largely verified by a comparison with measured data obtained during a full scale pile driving test carried out by the University of Washington, the Washington State Dept. of Transportation, and Washington State Ferries at the Vashon Island ferry terminal in November 2009.

Prior art efforts to mitigate the propagation of high sound pressure levels in water from pile driving have included the installation of sound abatement structures in the water surrounding the piles. For example, in *Underwater Sound Levels Associated With Pile Driving During the Anacortes Ferry Terminal Dolphin Replacement Project*, Tim Sexton, Underwater Noise Technical Report, Apr. 9, 2007 ("Sexton"), a test of sound abatement using bubble curtains to surround the pile during installation is discussed. A bubble curtain is a system that produced bubbles in a deliberate arrangement in water. For example, a hoop-shaped perforated tube may be provided on the sediment surrounding the pile, and provided with a pressurized air source, to release air bubbles near or at the sediment surface to produce a rising sheet of bubbles that act as a barrier in the water. Although significant sound level reductions were achieved, the pile driving operation still produced high sound levels.

Another method for mitigating noise levels from pile driving is described in a master's thesis by D. Zhou titled *Investigation of the Performance of a Method to Reduce Pile Driving Generated Underwater Noise* (University of Washington, 2009). Zhou describes and models a noise mitigation apparatus dubbed Temporary Noise Attenuation Pile (TNAP) wherein a steel pipe is placed about a pile before driving the pile into place. The TNAP is hollow-walled and extends from the sediment to above the water surface. In a particular apparatus disclosed in Zhou the TNAP pipe is placed about a pile having a 36-inch outside diameter. The TNAP pipe has an inner wall with a 48-inch O.D., and an outer wall with a 54-inch O.D. A 2-inch annular air gap separates the inner wall from the outer wall.

Although the TNAP did reduce the sound levels transmitted through the water, not all criteria for noise reduction were achieved.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

A pile is configured for noise abatement during driving and includes a shoe, an outer tube elastically connected to the shoe substantially isolating the outer tube from high frequency vibrations of the shoe, for example frequencies of 20 Hz or greater. An inner member extends through the outer tube and engages the driving shoe, defining an annular channel therebetween, and extends upwardly from the outer tube. An annular seal is provided near a lower end of the annular channel. The pile is configured to be driven into the ground by a driver that engages the inner member without engaging the outer tube. In a particular embodiment the driver is a vibratory pile driver, and the inner member is configured to clamp to the vibratory driver.

In an embodiment, the inner member is configured to be removed after the pile is driven into the ground.

In an embodiment, the outer tube is pulled into the ground by the shoe during the pile driving.

In an embodiment the outer tube is connected to the shoe with an annular elastic member and a compression spring. In another embodiment the lower portion of the outer tube has a lower portion with geometrical features that increase its elasticity, for example a plurality of apertures, or a thinner wall thickness. In an embodiment, an annular seal is provided in the annular channel above a plurality of apertures. For example, the seal may be an inflatable bladder.

In an embodiment, the annular channel if filled with a compressible material. In a particular embodiment, the compressible material is air or polymeric foam.

In an embodiment one of the outer tube and the inner member further comprises a lower retainer and an upper retainer that extend into the annular channel, and the other of the outer tube and the inner member further comprises an intermediate retainer that extends into the annular channel and is located between the lower retainer and the upper retainer, and further comprising a first spring disposed between the upper retainer and the intermediate retainer, and a second spring disposed between the intermediate retainer and the lower retainer.

In an embodiment, one of the outer tube and the inner member further comprises a lower retainer and an upper retainer that extend into the annular channel, and the other of the outer tube and the inner member further comprises an intermediate retainer that extends into the annular channel and is located between the lower retainer and the upper retainer, and further comprising a first spring disposed between the upper retainer and the intermediate retainer, and a second spring disposed between the intermediate retainer and the lower retainer. For example, the first and second springs may be compression springs.

In an embodiment, an annular shear spring is disposed in the annular channel between the outer tube and the inner member.

A pile is configured for noise abatement during driving, and includes a pile driving shoe, an inner member rigidly connected to the pile driving shoe, an outer tube extending around the inner member and elastically connected to one or both of the pile driving shoe and the inner member, defining an annular channel between the inner member and the outer tube, and the outer tube is shorter than the inner member such that the inner member extends upwardly out of the outer tube, and the pile is configured to be driven into the ground by a pile driver that engages the inner member without engaging the outer tube.

In an embodiment, the inner member is a tube that is configured to engage a vibratory pile driver.

In an embodiment a seal is provided that sealingly engages a lower end of the annular channel.

In an embodiment the seal defines a shear spring elastically connecting the inner member to the outer tube.

In an embodiment the outer tube has a plurality of apertures on a bottom portion of the outer tube, below the seal.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1A:
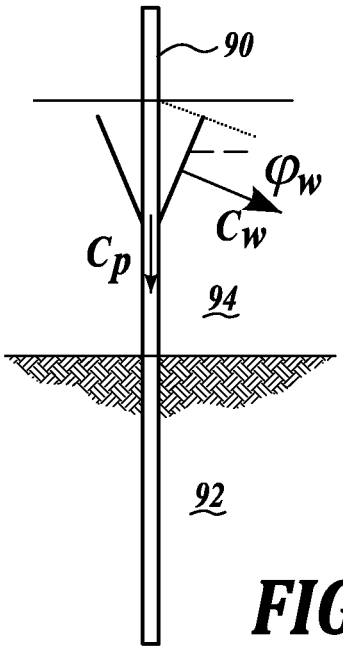
FIGS. 1A-1D illustrate the primary wave fronts associated with the Mach cone generated by a representative pile compression wave.

To investigate the acoustic radiation due to a pile strike we created an axisymmetric finite element model of a 30-inch radius, 32 m long hollow steel pile with a wall thickness of one inch submerged in 12.5 m of water and driven 14 m into the sediment. The radius of the water and sediment domain was 10 m. Perfectly matched boundary conditions were used to prevent reflections from the boundaries that truncate the water and sediment domains. The pile was fluid loaded via interaction between the water/sediment. All domains were meshed using quadratic Lagrange elements.

The pile was impacted with a pile hammer with a mass of 6,200 kg that was raised to a height of 2.9 m above the top of the pile. The velocity at impact was 7.5 m/s, and the impact pressure as a function of time after impact was examined using finite element analysis and approximated as:

$$P(t)=2.7*10^8\exp(-t/0.004)Pa \quad (1)$$

The acoustic medium was modeled as a fluid using measured water sound speed at the test site, $c_w$, and estimated sediment sound speed, $c_s$, of 1485 m/s and 1625 m/s, respectfully. The sediment speed was estimated using coring data metrics obtained at the site, which is characterized by fine sand and applied to empirical equations.

The present inventors conducted experiments to measure underwater noise from pile driving at the Washington State Ferries terminal at Vashon Island, Wash., during a regular construction project. The piles were approximately 32 m long and were set in 10.5 to 12.5 m of water depending on tidal range. The underwater sound was monitored using a vertical line array consisting of nine hydrophones with vertical spacing of 0.7 m, and the lowest hydrophone placed 2 m from the bottom. The array was set such that the distance from the piles ranged from 8 to 12 m.

Pressure time series recorded by two hydrophones located about 8 m from the pile showed the following key features:

1. The first and highest amplitude arrival is a negative pressure wave of the order of 10-100 kPa;

2. The main pulse duration is ~20 ms over which there are fluctuations of 10 dB; during the next 40 ms the level is reduced by 20 dB; and 3. There are clearly observable time lags between measurements made at different heights off the bottom. These time lags can be associated with the vertical arrival angle.

The finite element analysis shows that the generation of underwater noise during pile driving is due to a radial expansion wave that propagates along the pile after impact. This structural wave produces a Mach cone in the water and the sediment. An upward moving Mach cone produced in the sediment after the first reflection of the structural wave results in a wave front that is transmitted into the water. The repeated reflections of the structural wave cause upward and downward moving Mach cones in the water. The corresponding acoustic field consists of wave fronts with alternating positive and negative angles. Good agreement was obtained between a finite element wave propagation model and measurements taken during full scale pile driving in terms of angle of arrival. Furthermore, this angle appears insensitive to range for the 8 to 12 m ranges measured, which is consistent with the wave front being akin to a plane wave.

The primary source of underwater sound originating from pile driving is associated with compression of the pile. Refer to FIGS. 1A-1D, which illustrate schematically the transient behavior of the reactions associated with an impact of a pile driver (not shown) with a pile 90. In FIG. 1A, the compression wave in the pile due to the hammer strike produces an associated radial displacement motion due to the effect of Poisson's ratio of steel (0.33). This radial displacement in the pile propagates downwards (indicated by downward arrow) with the longitudinal wave with wave speed of $c_p$=4,840 m/s when the pile 90 is surrounded by water 94. Since the wave speed of this radial displacement wave is higher than the speed of sound in the water 94 the rapidly downward propagating wave produces an acoustic field in the water 94 in the shape of an axisymmetric cone with an apex traveling along with the pile deformation wave front. This Mach cone is formed with a cone angle of $\phi_w=\sin^{-1}(c_w/c_p)=17.9°$.

Figure 1B:
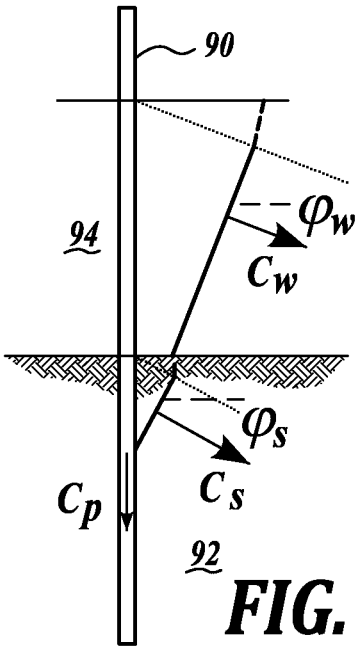

Note that this is the angle formed between the vertically oriented pile 90 and the wave front associated with the Mach cone; it is measured with a vertical line array, and here it will be manifested as a vertical arrival angle with reference to horizontal. This angle only depends on the two wave speeds and is independent of the distance from the pile. As illustrated in FIG. 1B, the Mach cone angle changes from $\phi_w$ to $\phi_s=\sin^{-1}(c_w/c_p)=19.7°$ as the pile bulge wave enters sediment 92. Note that the pile bulge wave speed in the sediment 92 is slightly lower due to the higher mass loading of the sediment 92 and is equal to $c_p$=4,815 m/s.

Figure 1C:
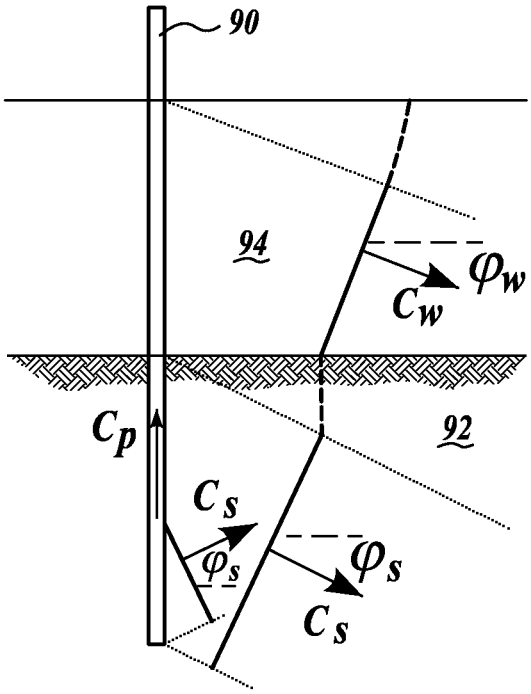
Figure 1D:
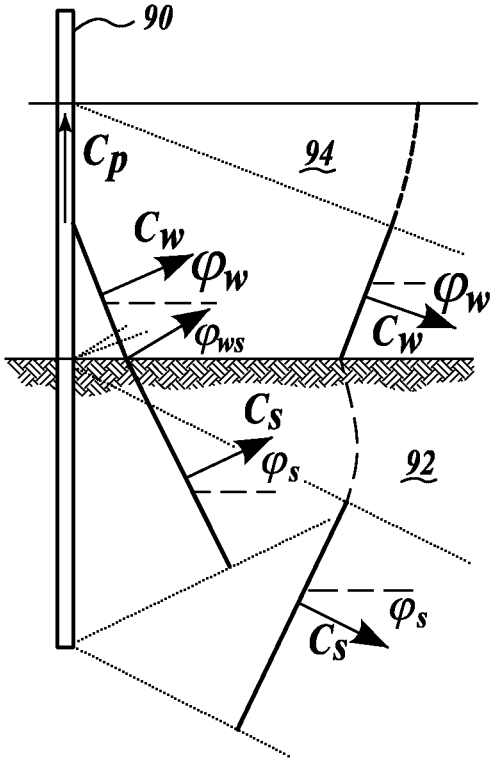
Figure 2:
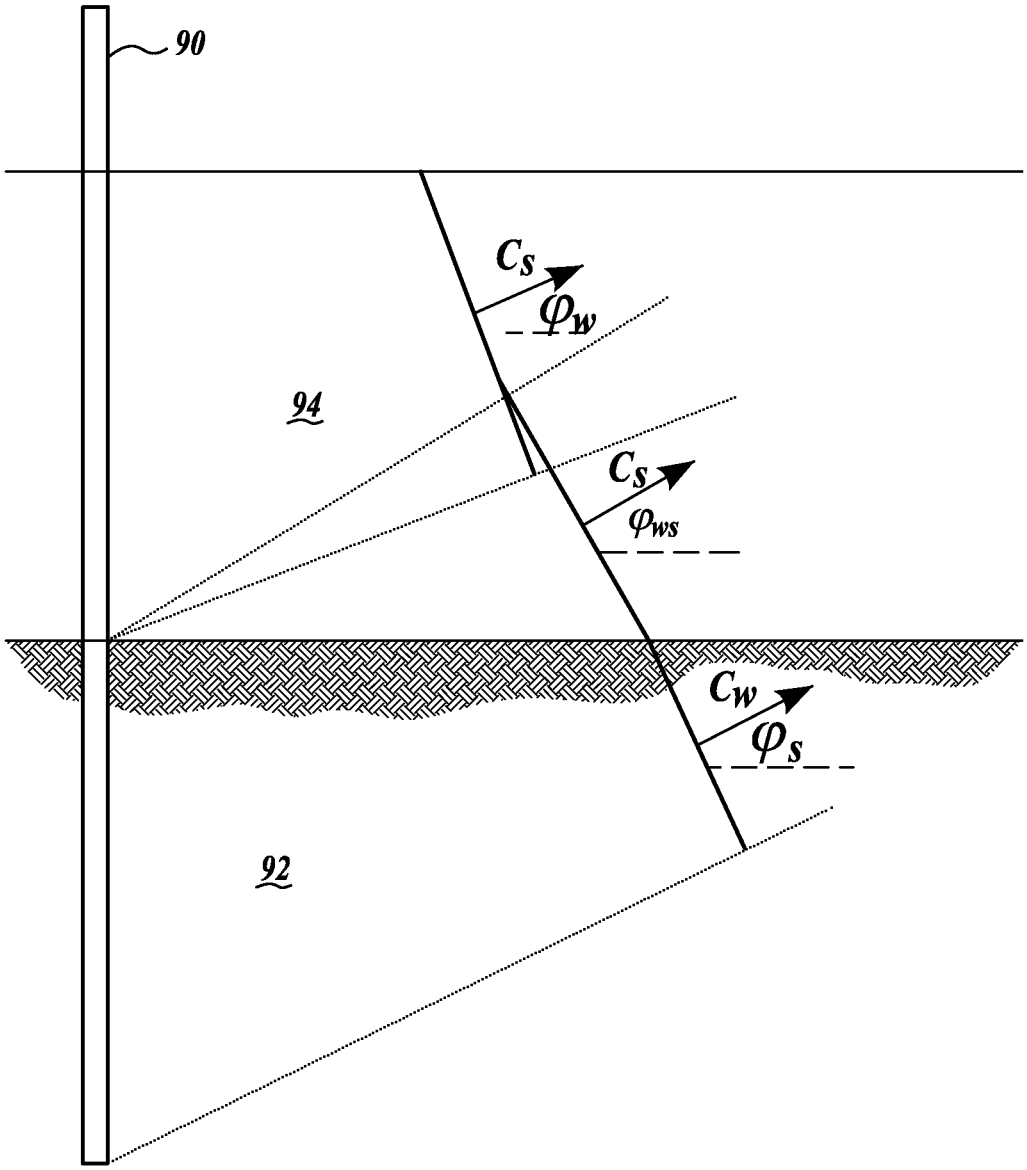
FIG. 2 illustrates only the first upwardly traveling wave front for the representative pile compression wave illustrated in FIGS. 1A-1D.

As the wave in the pile reaches the pile 90 terminal end it is reflected upwards (FIG. 1C). This upward traveling wave in turn produces a Mach cone of angle $\phi_s$ (defined as negative with respect to horizontal) that is traveling up instead of down. The sound field associated with this cone propagates up through the sediment 92 and penetrates into the water 94. Due to the change in the speed of sound going from sediment 92 to water 94 the angle of the wave front that originates in the sediment 92 changes from $\phi_s$ to $\phi_{sw}$=30.6° following Snell's law. Ultimately, two upward moving wave fronts occur as shown schematically in FIG. 1D and more clearly in FIG. 2. One wave front is oriented with angle $\phi_{sw}$ and the other wave front with angle $\phi_{ws}$. The latter is produced directly by the upward moving pile wave front in the water 94. (Other features of propagation such as diffraction and multiple reflections are not depicted in these schematic illustrations, for clarity.)

Based on finite element analyses performed to model the transient wave behavior generated from impacts generated when driving a steel pile, the generation of underwater noise during pile driving is believed to be due to a radial expansion wave that propagates along the pile after impact. This structural wave produces a Mach cone in the water and the sediment. An upwardly moving Mach cone produced in the sediment after the first reflection of the structural wave results in a wave front that is transmitted into the water. Repeated reflections of the structural wave cause upward and downward moving Mach cones in the water.

It is believed that prior art noise attenuation devices, such as bubble curtains and the TNAP discussed above, have limited effectiveness in attenuating sound levels transmitted into the water because these prior art devices do not address sound transmission through the sediment. As illustrated most clearly in FIG. 2, an upwardly traveling wave front propagates through the sediment 92 with a sound speed $c_w$. This wave front may enter the water outside of the enclosure defined by any temporary barrier, such as a bubble curtain or TNAP system, for example, such that the temporary barrier will have little effect on this component of the sound.

Although the above analysis is described with reference to a driver impacting the pile, it will be apparent to persons of skill in the art that the transmission of acoustic waves from the pile, through the sediment, and into the environment beyond will also occur in vibratory driving of piles. As discussed above, the vibratory pile driver clamps to the pile, and imparts vertical vibrations to the pile, partially fluidizing the sediment, such that the pile is driven into the sediment by the weight of the pile and the vibratory pile driver, and the vertical forces produced by the vibratory driver. As in the case of impact driving, the vertical force imparted by the vibratory hammer produces a radial motion of the pile that excites the surrounding water and sediment. This produces high intensity radiated noise in the water and sediment. Except where a method or apparatus is clearly not applicable to use with a vibratory pile driver, the methods and apparatus discussed below will reduce noise transmission to the environment through the sediment for either hammer pile driving or vibratory pile driving.

Figure 3:
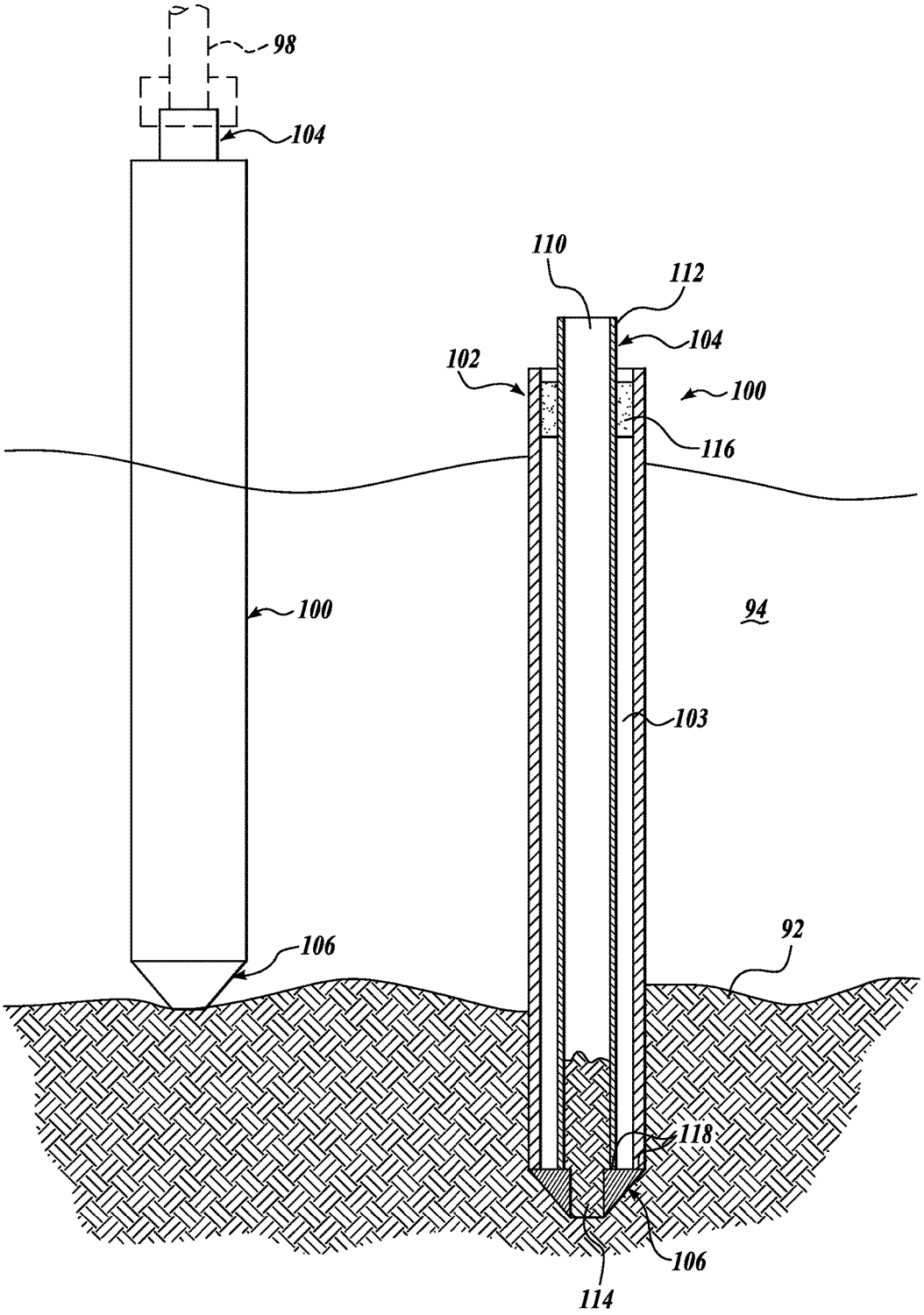
FIG. 3 illustrates two piles in accordance with the present invention, wherein one pile (on the left) is in position to be driven into an installed position, and the other pile (on the right) is shown installed and in cross section.

FIG. 3 illustrates a pair of noise-attenuating piles 100 in accordance with the present invention. In FIG. 3, the noise-attenuating pile 100 on the left is shown in position to be driven into the desired position with a pile driver 98, which is schematically indicated in phantom at the top of the pile 100. The identical noise-attenuating pile 100 on the right in FIG. 3 is shown in cross section and installed in the sediment 92.

The noise-attenuating pile 100 includes a structural outer tube 102, a generally concentric inner tube 104, and a tapered driving shoe 106. In a current embodiment the outer tube 102 is sized and configured to accommodate the particular structural application for the pile 100, e.g., to correspond to a conventional pile. In one exemplary embodiment the outer tube 102 is a steel pipe approximately 89 feet long and having an outside diameter of 36 inches and a one-inch thick wall. Of course, other dimensions and/or materials may be used and are contemplated by the present invention. The optimal size, material, and shape of the outer tube 102 will depend on the particular application. For example, hollow concrete piles are known in the art, and piles having non-circular cross-sectional shapes are known.

As discussed in more detail below, the outer tube 102 is not impacted directly by the pile driver 98, and is pulled into the sediment 92 rather than being driven directly into the sediment. This aspect of the noise-attenuating pile 100 will facilitate the use of non-steel structural materials for the outer tube 102, such as reinforced concrete.

The inner tube 104 is generally concentric with the outer tube 102 and is sized to provide an annular channel or space 103 between the outer tube 102 and the inner tube 104. The inner tube 104 may be formed from a material similar to the inner tube 104, for example, steel, or may be made of another material such as concrete. For example, the inner tube 104 may be concrete. It is also contemplated that the inner tube 104 may be formed as a solid elongate rod rather than tubular. In a particular embodiment, the inner tube 104 comprises a steel pipe having an outside diameter of 24 inches and a ⅜-inch wall thickness, and the annular channel 103 is about six inches thick.

In a particular embodiment the outer tube 102 and the inner tube 104 are both formed of steel. The outer tube 102 is the primary structural element for the pile 100, and therefore the outer tube 102 is thicker than the inner tube 104. The inner tube 104 is structurally designed to transmit the impact loads from the pile driver 98 to the driving shoe 106.

The driving shoe 106 in this embodiment is a tapered annular member having a center aperture 114. The driving shoe 106 has a wedge-shaped cross section, tapering to a distal end defining a circular edge, to facilitate driving the pile 100 into the sediment 92. In a current embodiment the driving shoe 106 is steel. The outer tube 102 and inner tube 104 are fixed to the proximal end of the driving shoe 106, for example, by welding 118 or the like. Other attachment mechanisms may alternatively be used; for example, the driving shoe 106 may be provided with a tubular post portion that extends into the inner tube 104 to provide a friction fit. The driving shoe 106 maximum outside diameter is approximately equal to the outside diameter of the outer tube 102, and the center aperture 114 is preferably slightly smaller than the diameter of an axial channel 110 defined by the inner tube 104. It will be appreciated that the center aperture 114 permits sediment to enter into the inner tube 104 when the pile 100 is driven into the sediment 92. The slightly smaller diameter of the driving shoe center aperture 114 will facilitate sediment entering the inner tube 104 by reducing wall friction effects within the inner tube 104.

It will be appreciated from FIG. 3 that the inner tube 104 is longer than the outer tube 102, such that a portion 112 of the inner tube 104 extends upwardly beyond the outer tube 102. This configuration facilitates the pile driver 98 engaging and impacting only the inner tube 104. It is contemplated that other means may be used to enable the driver to impact the inner tube 104 without impacting the outer tube 102. For example, the pile driver 98 may be formed with an engagement end or an adaptor that fits within the outer tube 102. The important aspect is that the pile 100 is configured such that the pile driver 98 does not impact the outer tube 102, but rather impacts only the inner tube 104.

At or near the upper end of the pile 100, a compliant member 116, for example, an epoxy or elastomeric annular sleeve, may optionally be provided in the annular channel 103 between the inner tube 104 and the outer tube 102. The compliant member 116 helps to maintain alignment between the tubes 102, 104, and may also provide an upper seal to the annular channel 103. Although it is currently contemplated that the annular channel 103 will be substantially air-filled, it is contemplated that a filler material may be provided in the annular channel 103, for example, a spray-in foam or the like. The filler material may be desirable to prevent significant water from accumulating in the annular channel 103, and/or may facilitate dampening the compression waves that travel through the inner tube 104 during installation of the pile 100.

The advantages of the construction of the pile 100 can now be appreciated with reference to the preceding analysis. As the inner tube 104 is impacted by the pile driver 98, a deformation wave propagates down the length of the inner tube 104 and is reflected when it reaches the driving shoe 106, to propagate back up the inner tube 104, as discussed above. The outer tube 102 portion of the pile 100 substantially isolates both the surrounding water 94 and the surrounding sediment 92 from the traveling Mach wave, thereby mitigating sound propagation into the environment. The outer tube 102, which in this embodiment is the primary structural member for the pile 100, is therefore pulled into the sediment by the driving shoe 106, rather than being driven into the sediment through driving hammer impacts on its upper end.

Figure 4:
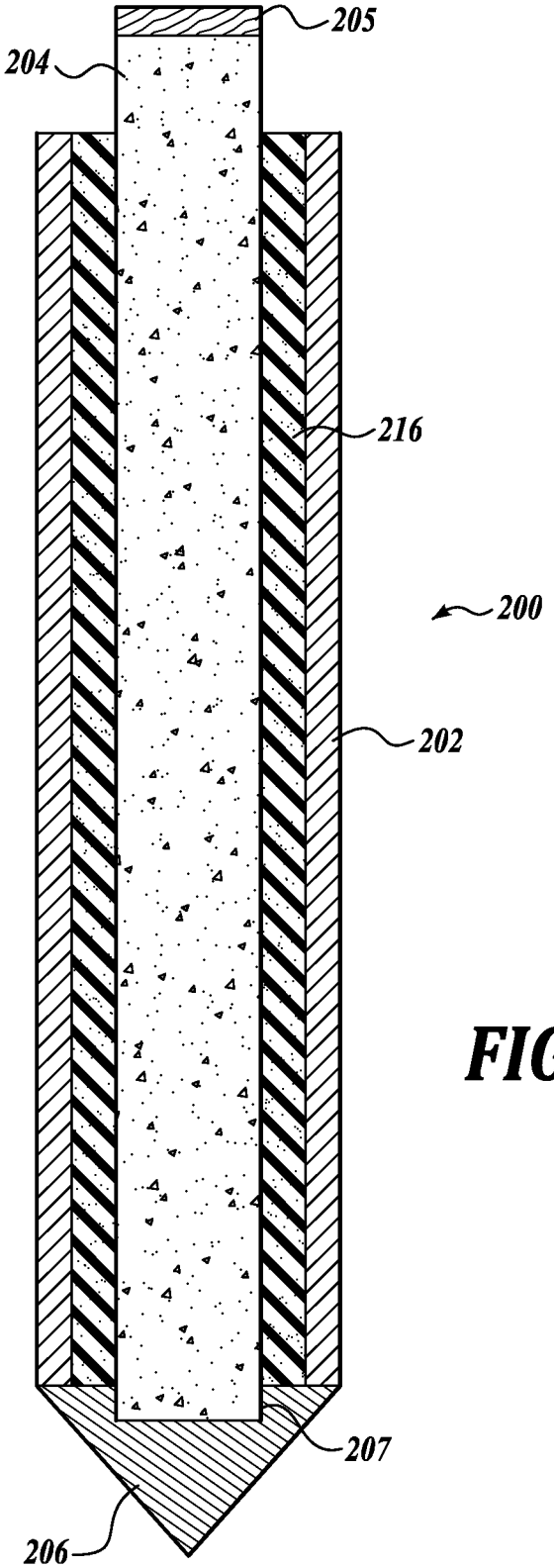
FIG. 4 shows another embodiment of a pile in accordance with the present invention.

A second embodiment of a noise-attenuating pile 200 in accordance with the present invention is shown in cross-sectional view in FIG. 4. In this embodiment the pile 200 includes an outer tube 202, which may be substantially the same as the outer tube 102 discussed above. A solid inner member 204 extends generally concentrically with the outer tube 202 and is formed from concrete. The inner member 204 may have a hexagonal horizontal cross section, for example. A tapered driving shoe 206 is disposed at the distal end of the pile 200, and is conical or frustoconical in shape, and may include a recess 207 that receives the inner member 204. In a currently preferred embodiment the driving shoe 206 is made of steel. The outer tube 202 is attached to the driving shoe 206, for example, by welding or the like. The inner member 204 in this embodiment extends above the proximal end of the outer tube 204. Although not a part of the pile 200, a wooden panel 205 is illustrated at the top of the inner member 204, which spreads the impact loads from the pile driver, to protect the concrete inner member 204 from crumbling during the driving process. Optionally, in this embodiment a filler 216 such as a polymeric foam substantially fills the annular volume between the outer tube 202 and the inner member 204.

It is contemplated that in an alternate similar embodiment, an outer tube may be formed of concrete, and an inner tube or solid member may be formed from steel or a similarly suitable material.

Figure 5:
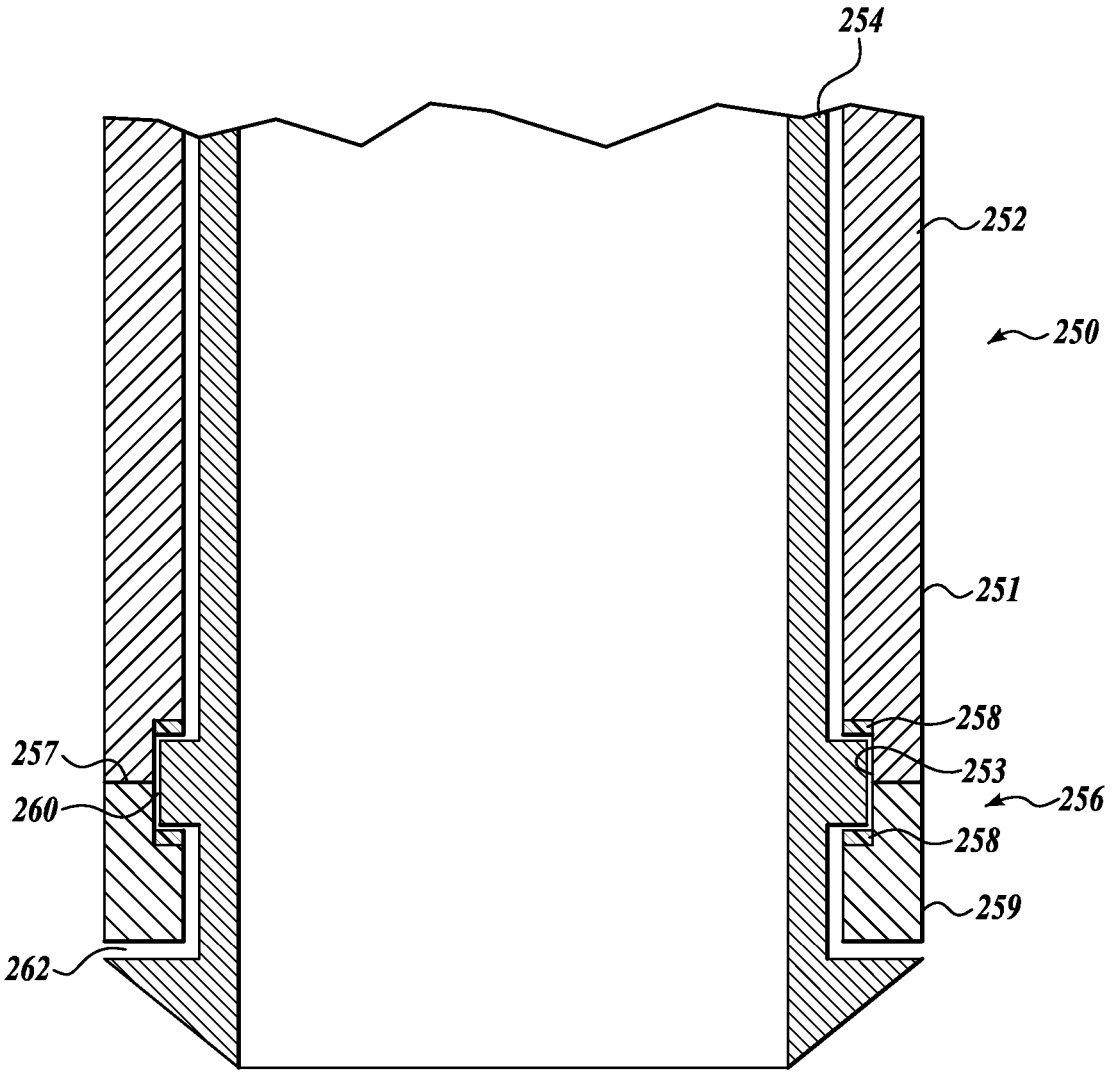
FIG. 5 shows a fragmentary view of the distal end of an embodiment of a pile in accordance with the present invention.

FIG. 5 shows a fragmentary cross-sectional view of an alternative embodiment of a pile 250 having an inner tube 254 and an outer tube 252. The pile 250 is similar to the pile 100 disclosed above, but wherein the driver shoe 256 is formed integrally with the inner tube 254. In this embodiment, the distal end portion of the inner tube 254 includes an outer projection or flange 260. For example, the flange 260 may be formed separately and welded or otherwise affixed to the distal end portion of the inner tube 254. The outer tube 252 is configured with a corresponding annular recess 253 on an inner surface, which is sized and positioned to retain or engage the flange 260. In an exemplary construction method the outer tube 252 is formed from two pieces, an elongate upper piece 251 having an inner circumferential groove on its bottom end, and a distal piece 259 having a corresponding inner circumferential groove on its upper end. The distal piece 259 may further be formed in two segments to facilitate placement about the inner tube 254. The upper piece 251 and distal piece 259 may then be positioned about the inner tube 254 such that the flange 260 is captured in the annular recess 253, and the upper piece 251 and distal piece 259 welded 257 or otherwise fixed together. The inner tube 254 and outer tube 252 are therefore interlocked by the engagement of the inner tube flange 260 and the outer tube annular recess 253. One or two low-friction members 258 (two shown), for example, nylon washers, may optionally be provided.

In the embodiment of FIG. 5, the flange 260 is sized such that a gap is formed between an outer surface of the flange 260 and an inner surface of the annular recess 253. Also, the length of the outer tube 252 is configured to provide a gap 262 between the bottom of the outer tube 253 and the horizontal surface of the shoe 256 near the distal end of the inner tube 254. It will now be appreciated that as the radial displacement waves induced by the pile driver travel along the inner tube 254, the outer tube 252 will be further isolated from the radial displacement waves due to the gap 262. An annular channel between the inner tube 254 and the outer tube 252 in this embodiment may optionally be sealed with a sleeve, which may be formed with a polymeric foam or other sealing material as are known in the art.

Figure 6:
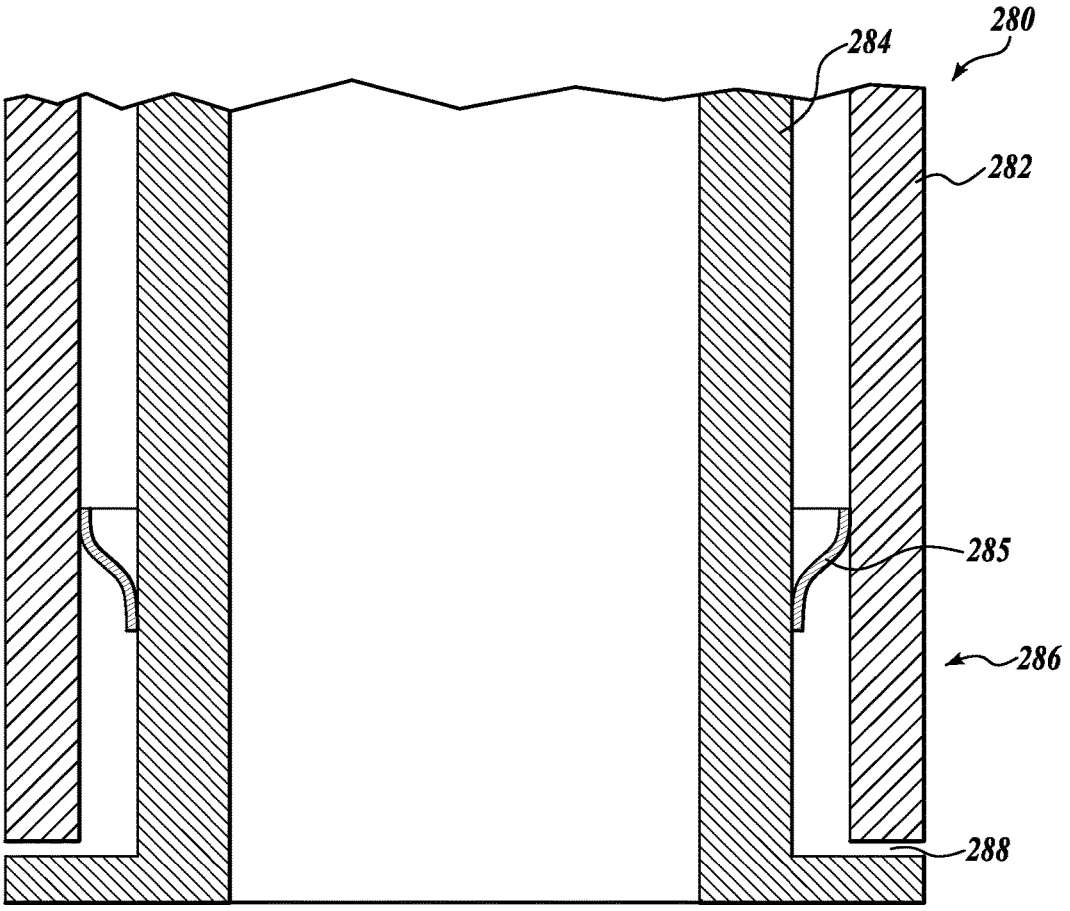
FIG. 6 illustrates an elastic connection mechanism that may alternatively be used to isolate the outer tube from the inner member in alternative embodiments of a pile in accordance with the present invention.

Although a flange and recess connection is shown in FIG. 5, it is also contemplated, as illustrated in FIG. 6, that a pile 280 in accordance with the present invention may include an elastic or compliant connector 285 and may alternatively be provided between the inner tube 284 and the outer tube 282 of the pile 280. It is contemplated, for example, that the elastic connector 285 connecting the inner tube and outer tube may be an annular linear elastic spring member with an inner edge fixed to the inner tube 284 and an outer edge fixed to the outer tube 282. In this embodiment the driving shoe 286 is formed integrally with the inner and outer tubes 284, 282, and the elastic connector 285 substantially isolates the outer tube 282 from the radial compression waves induced in the inner tube 284 by the driver.

Although the piles 100, 200 are shown in a vertical orientation, it will be apparent to persons of skill in the art, and is contemplated by the present invention, that the piles 100, 200 may alternatively be driven into sediment at an angle.

Figure 7C:
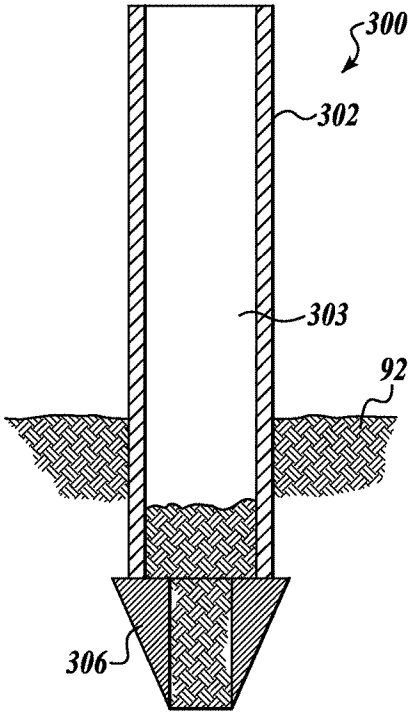
FIGS. 7A-7C illustrate a pile in accordance with the present invention, wherein the inner member is removed after installing the pile.
Figure 7B:
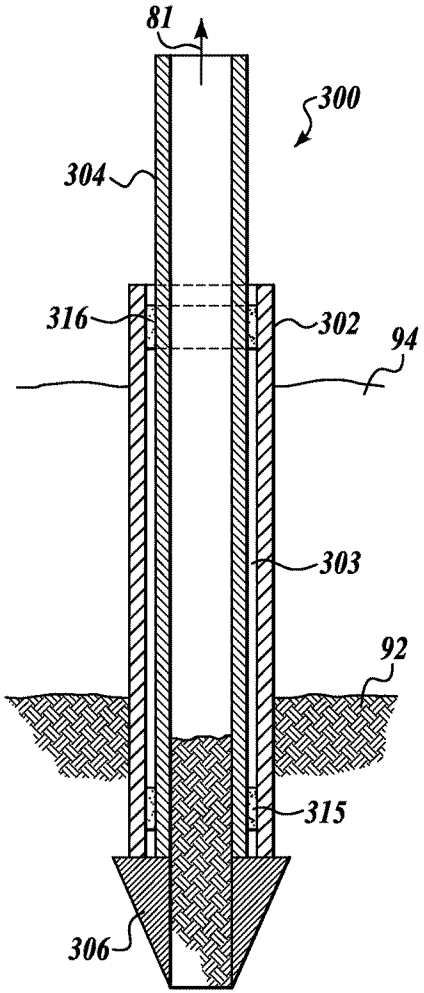
Figure 7A:
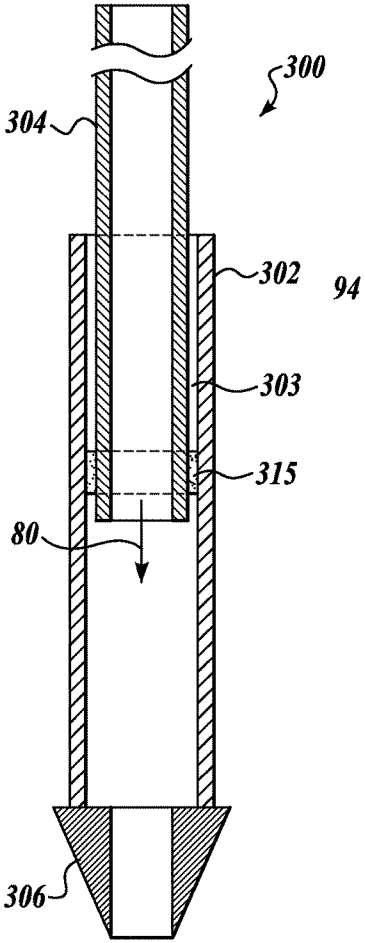

Another noise-attenuating pile 300 in accordance with the present invention is shown in cross-sectional view in FIGS. 7A-7C. The pile 300 includes an outer tube 302 that is fixed to a driving shoe 306. For example, the outer tube 302 and driving shoe 306 may be substantially the same as the corresponding components described above.

A removable inner member 304 is sized and configured to be inserted into the outer tube 302, and positioned to define an annular channel 303 therebetween. The annular channel may be, for example, greater than one inch thick. The removable inner member 304 is sized to abut or engage the driving shoe 306 when fully inserted into the outer tube 302. As discussed with reference to the piles 100, 200 disclosed above, the pile 300 is configured such that only the inner member 304 is impacted during installation of the pile 300. For example, as seen most clearly in FIG. 7B the inner member 304 extends above the upper end of the outer tube 302 when the inner member 304 engages the driving shoe 306. Alternatively, a rigid adapter or insert may be provide that extends into the upper end of the outer tube 302 to engage the inner member 304 and transmit the hammer impulses thereto during installation.

A first seal 315 is fixed to the inner member 304 and engages an inner wall of the outer tube 302. The first seal 315 is configured to seal the annular channel 303 near a lower end of the inner member 304 to prevent or limit the incursion of water into the channel 303 during installation. Although a single ring-shaped seal 315 is shown on the inner member 304, it will be apparent to persons of skill in the art that other seal arrangements may be used. For example, one or more O-ring seals may be used, or the seal may be fixed to an inner wall of the outer tube 302 and sized to receive the inner member 304. In another alternative embodiment a combination of one or more seals are fixed to the outer surface of the inner member 304 and one or more seals are fixed to the inner surface of the outer tube 302. The annular channel is preferably filled with a compressible material, for example, a gas such as air, a compressible foam, or the like.

Optionally an upper seal 316 spacer may be provided near an upper end of the annular channel 303.

It will be appreciated that in the pile 300, similar to the piles 100, 200 disclosed above, the outer tube 302, which contacts the water and sediment directly, does not experience the high-energy radial expansion waves during installation.

FIG. 7A shows the inner member 304 with the first seal being inserted into the outer tube 302, as indicated by arrow 80. In some applications the inner member 304 may be inserted before the pile is placed in the water. The assembled pile 300 may then be positioned at a desired location on the sediment 92 for installation. Alternatively, the shoe 306 and outer tube 302 assembly may be pre-positioned, and the inner member 304 inserted in situ. Suction or pump means (not shown) may then be used to remove water from the annular channel 303 prior to driving the pile 300.

FIG. 7B shows the pile 300 after it has been driven into the sediment 92. The inner member 304 may then be removed, as indicated by the arrow 81. It is contemplated that the lower seal 315 may be formed from a degradable material, for example, from a suitable biopolymer, to facilitate removal of the inner member 304 after installation.

FIG. 7C illustrates the installed pile 300 after removal of the inner member 304.

It is also contemplated that with minor modifications that would be apparent to persons of skill in the art, the pile 300 may be configured with the inner member 304 fixed to the shoe 306, and the outer tube 302 configured to removably abut or otherwise engage the driving shoe 306.

Figure 8A:
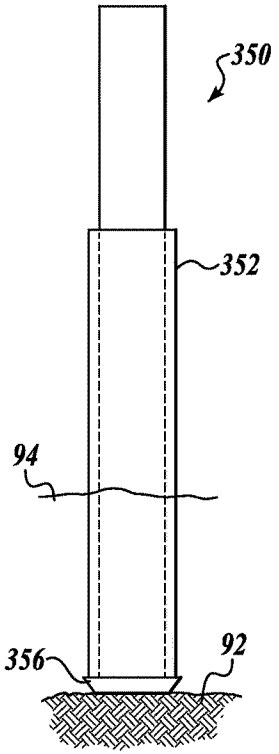
FIGS. 8A-8E illustrate a method for installing a pile with a removable outer tube, such that only the inner member remains in place after installation.
Figure 8B:
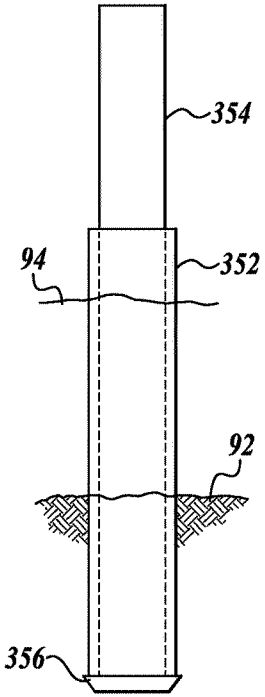
Figure 8C:
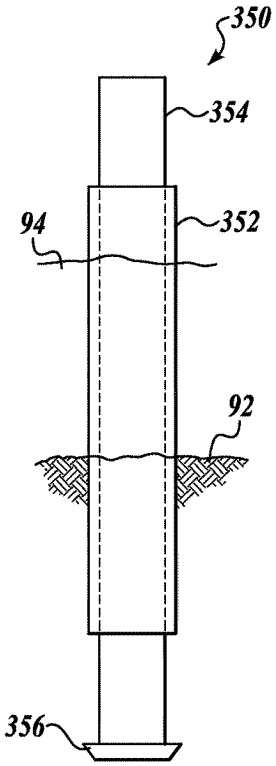
Figure 8D:
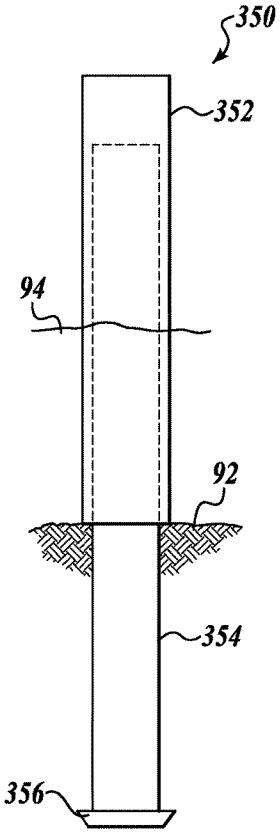
Figure 8E:
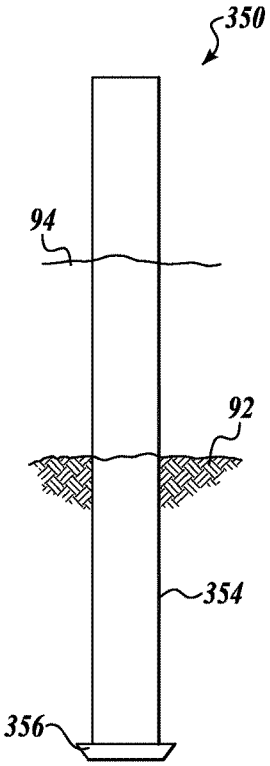

A sequence for installation of a pile 350 with a removable outer tube 352 is shown in FIGS. 8A-8E. In FIG. 8A the pile 350 is shown positioned with the driving shoe 356 on the ground or sediment 92 and ready for installation with a pile driver (not shown). The inner member 354 extends upwardly from the driving shoe 356 beyond the top of the outer tube 352, and is readily driven without impacting the outer tube 352. In FIG. 8B the pile 350 is shown driven into the sediment 92. Both the outer tube 352 and the inner member 354 remain directly engaged with the driving shoe 356. Optionally, the outer tube 352 may be decoupled from the shoe 356, and the inner member 354 driven further into the sediment 92. However, as discussed above this may not be desired because it may result in pressure waves being transmitted from the inner member 354, through the sediment 92, and into the water 94. The outer tube 354 may then be pulled out of the sediment 92, which is facilitated if the driving shoe 356 has a larger maximum radius than the outer tube 352. The outer tube 352 may be slightly tapered, for example, by 1-3 degrees to facilitate removal. Removal of the outer tube 352 may be aided by rotating and/or vibrating the outer tube 352 about its axis. It is also contemplated that a bubble generator (not shown) may be provided on or in the perimeter of driving shoe 356, and connected with a pressurized gas source, to facilitate removal of the outer tube 354.

Figure 9:
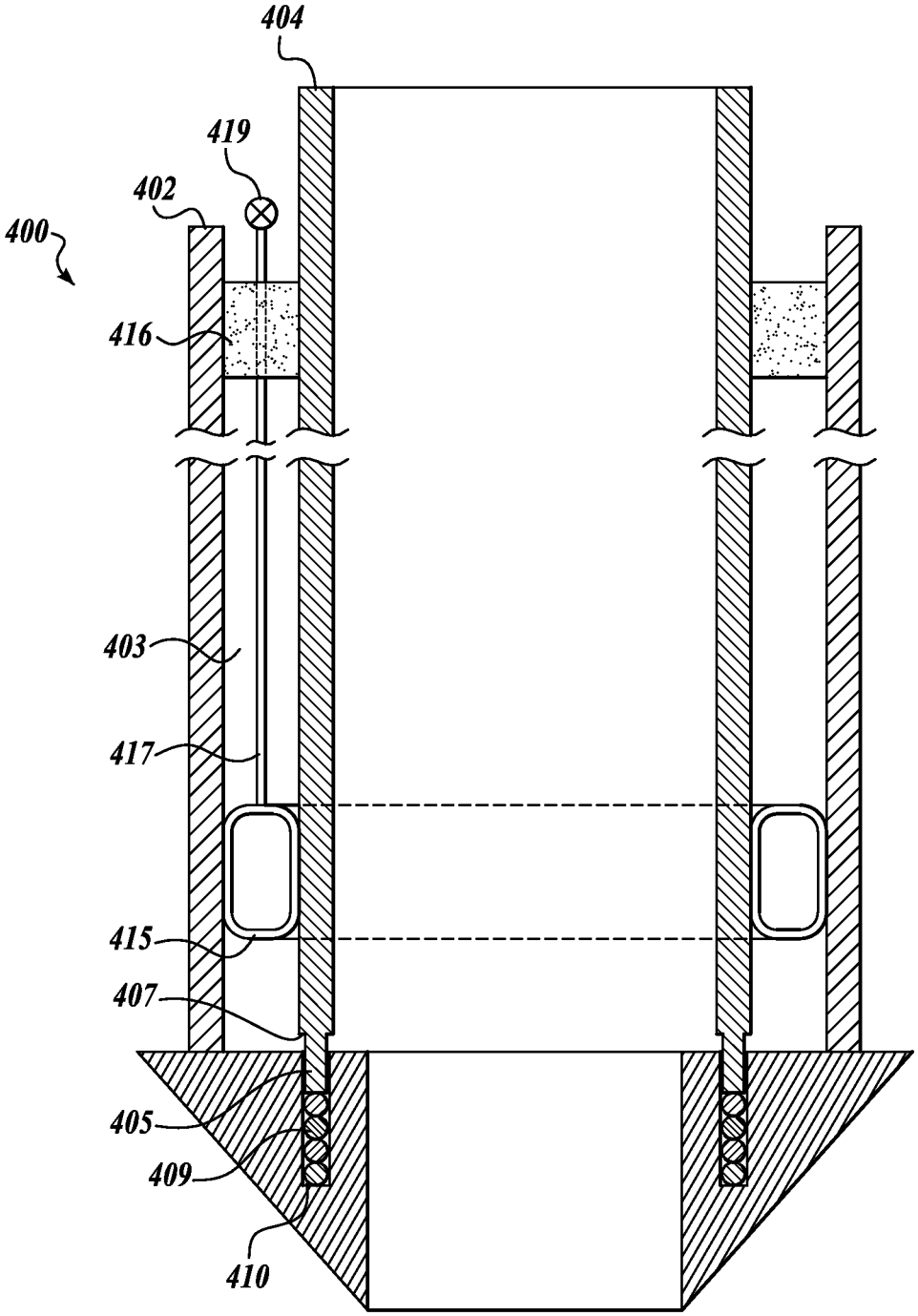
FIG. 9 is a cross-sectional view of another pile in accordance with the present invention with an elastic connection between the inner member and the driving shoe, and with an inflatable seal.

Another pile 400 in accordance with the present invention is shown in FIG. 9. The pile 400 is similar to the pile 300 described above, and similar aspects will not be repeated here, for brevity and clarity. In this embodiment the outer tube 402 and inner member 404 define an annular channel 403 therebetween, and the outer tube 402 is fixedly attached to the driving shoe 406. To further isolate the outer tube 402 from reflected radial compression waves during installation, the inner member 404 engages the driving shoe 406 through an elastic member 409. In this embodiment an annular recess 410 is provided in the driving shoe 406 that receives the elastic member 409, and the lower end 405 of the inner member 404 is sized and shaped to be inserted into the recess 410. Optionally, the lower end 405 may be narrower than the upper portion of the inner member 404, such that a ledge or abutment 407 is defined to provide a positive stop limiting the longitudinal travel of the inner member 404. Therefore, when the inner member 404 is hammered to install the pile 400, the peak impulse transmitted from the inner member 404 to the driving shoe 406 is reduced, thereby reducing the radial compression wave generated in the outer tube 402.

The elastic member 409 may be, for example, a stiff spring, a plurality of elastomeric washers, an annular block of elastomeric material, or a metal washer having a high Young's modulus.

It will be apparent to persons of skill in the art from the teachings herein that various alternative embodiments are possible. For example, the particular spring arrangement shown in FIG. 9 may be reversed with the elastic member 409 inserted into a recess in the inner member 404 and an annular extension provided on the driving shoe 406. Alternatively, the bottom portion of the inner member 404 may be configured to increase its elasticity or spring-like properties. For example, the bottom of the inner member 404 may be constructed from a more elastic material or modified to increase its elasticity, e.g., by providing apertures or recesses in the lower end of the inner member 404, or reducing the thickness thereof.

FIG. 9 also shows an annular bladder-type seal 415 fixed to the inner member 404. The bladder-type seal 415 includes one or more fill tubes 417 that extend upwardly along the annular channel 403, with a valve 419 at a distal end, for filling the bladder-type seal 415. The inner member 404 in this embodiment is inserted into the outer tube 402 with the bladder-type seal 415 deflated, to facilitate placement. The valve 419 is connected to a high-pressure fluid source or pump (not shown), and the seal 415 is inflated to a design pressure to form the desired seal. The fluid for the seal may be, for example, a fluid such as water or hydraulic oil, or a gas such as air. An optional upper seal 416 is also shown.

Figure 10B:
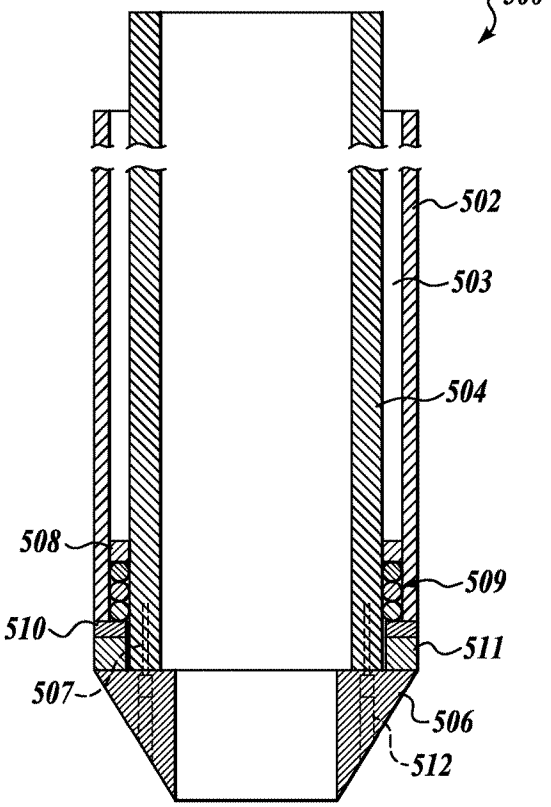
FIGS. 10A and 10B illustrate another pile in accordance with the present invention with a spring and/or seal connecting the inner member and the outer tube above the driving shoe.
Figure 10A:
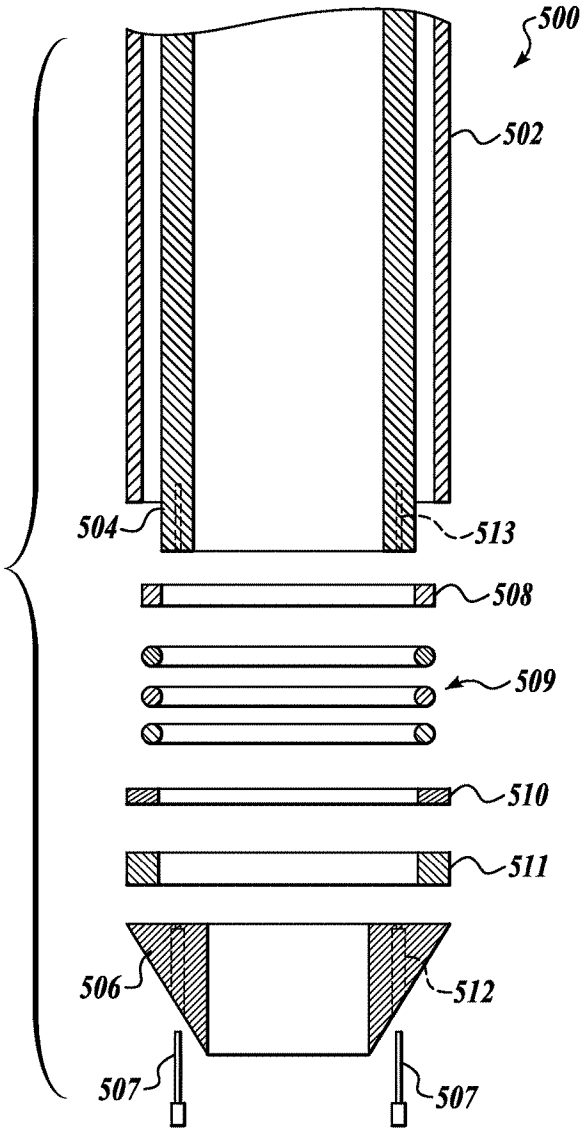

A portion of another pile 500 is shown in FIGS. 10A and 10B, wherein FIG. 10A shows an exploded view of the lower end of the pile 500, and FIG. 10B shows the assembled pile 500. The driving shoe 506 is attached to the inner member 504 with a plurality of bolts 507 that extend through the shoe 506 and engage the threaded apertures 513 in the bottom of the inner member 504.

An annular first flange member 510 extends inwardly from the outer tube 502. The first flange member 510 is shown fixed to the bottom edge of the outer tube 502, for example, by welding or the like. However, any conventional means for attaching or forming the first flange 510 may be used. For example, the first flange may be formed with an L-shaped cross section, and the vertical leg bolted, welded, or otherwise fixed to an inner surface of the outer tube 502. A second annular flange member 508 extends outwardly from the inner member 504 and is positioned generally above the first flange member 510.

An elastic member or spring 509 is disposed between the first and second flange members 510, 508. For example, the spring 509 may be a stiff compression spring as are known in the art or may comprise a length of tubular elastomeric material. In a particular embodiment the spring 509 is formed from a plurality of stacked elastomeric O-rings, which are configured to also provide a good seal to the annular channel 503 between the outer tube 502 and the inner member 504. Optionally, a ring-shaped member 511 formed from a relatively elastic material may also be provided between the driving shoe 506 and the outer tube 502, to further isolate the outer tube 502 from pressure waves reflected from the driving shoe 506. In this pile 500, the pile driver (not shown) impacts only the inner member 504, as discussed for other piles above, and a portion of the driving force is transmitted to the outer tube 502 through the second flange member 508, the spring 509, and the first flange member 510.

Figure 11:
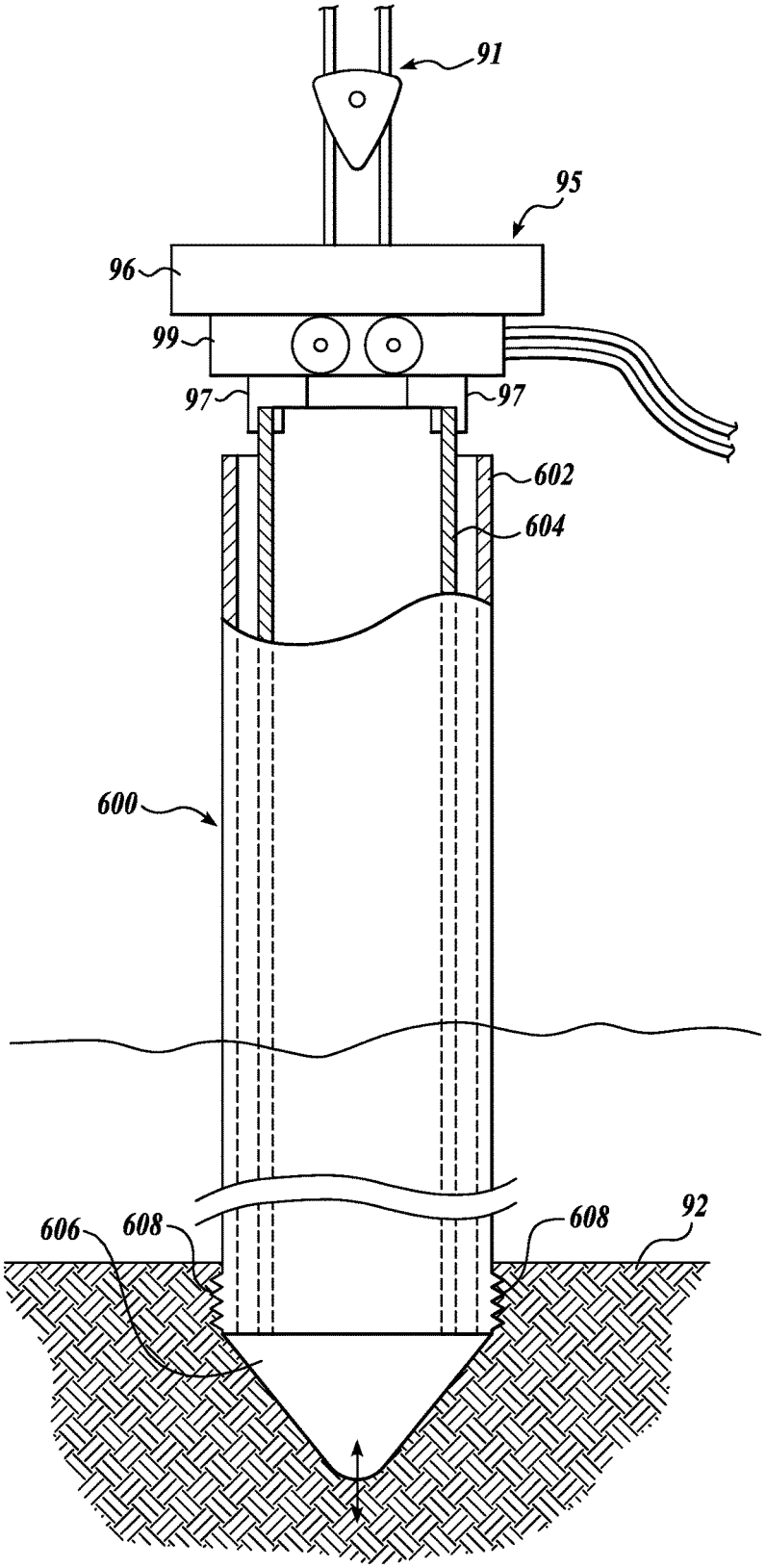
FIG. 11 is a partially cutaway view of an upper portion of a pile in accordance with the present invention, with a vibratory driver clamped to an upper end of the inner tube.

Referring now to FIG. 11, a pile 600 having an outer tube 602 and an inner member 604 in accordance with the present invention is shown, wherein the inner member 604 extends upwardly from the outer tube 602. A vibratory hammer or pile driver 95 is fixed to an upper end of the inner member 604 of the pile 600 with one or more clamping members 97, for example, hydraulic clamping members. The vibratory driver 95 does not directly engage the outer tube 602. The vibratory driver 95 may be any conventional vibratory driver 95, as are known in the art. The vibratory driver 95 includes a support frame 96 that may include vibration suppression components (not shown), and a vibrator assembly 99 suspended from the support frame 96.

The vibrator assembly 99, which may be hydraulically or electrically driven but is not limited to such drives includes a system of counter-rotating eccentric weights configured to generate vertical vibrations and to cancel horizontal vibrations. The vertical vibrations are transmitted to the inner member 604 through the clamping members 97. The inner member 604 transmits the vertical vibrations to the driving shoe 606. The vibration in the shoe 606 can cause the soil or sediment 92 below the pile to fluidize, to facilitate emplacement of the pile 600. The vibratory driver 95 is typically lifted into place by a crane or excavator 91, for example.

A vibratory driver 95 may be advantageously used to emplace any of the piles described above, and illustrated in FIGS. 3-13.

As noted above, the vibratory driver 95 does not directly engage the outer tube 602. Moreover, in the pile 600 the outer tube 602 is elastically connected to the shoe 606, as indicated schematically in FIG. 11 by springs 608. Although springs between the outer tube 602 and the shoe 606 are shown, it is contemplated that the outer tube 602 may be indirectly connected to the shoe 606, for example, through an elastic connection to the inner member 604. The inner member 604 is rigidly connected to the shoe 606. The elastic connection 608 may be implemented in a number of ways, as are well-known in the art. For example, the lower end of the outer tube 602 may be formed from a material that is significantly more elastic than the rest of the outer tube 602, or the lower end may be thinner or provided with apertures, to greatly increase the elasticity of the lower end of the outer tube 602. Alternatively, or in addition, an elastic material, for example, a polymeric bumper may be used to attach the outer tube 602 to the shoe 606. In another example, the outer tube 602 may be attached to the rest of the pile 600 with a mechanical spring member (not shown). Any conventional spring may be used.

It should be appreciated that elastically connecting the outer tube 602 to the driving shoe 606 will substantially isolate the outer tube 602 from vibrations of the driving shoe 606. For example, the elastic connection 608 of the outer tube 602 is selected to substantially isolate the outer tube 602 from vibrations in the driving shoe 606 greater than about 20 hz. Therefore, vibrational impulses applied to the pile 600 by the vibrational driver 95 are not transmitted to the outer tube 602.

In the pile 600, the outer tube 602 is operably attached to the shoe 606 and is pulled into the sediment 92 by the shoe 606. The outer tube 602 does not transmit the vibration energy from the pile driver into the sediment 92, mitigating the transmission of noise into the environment.

Figure 12A:
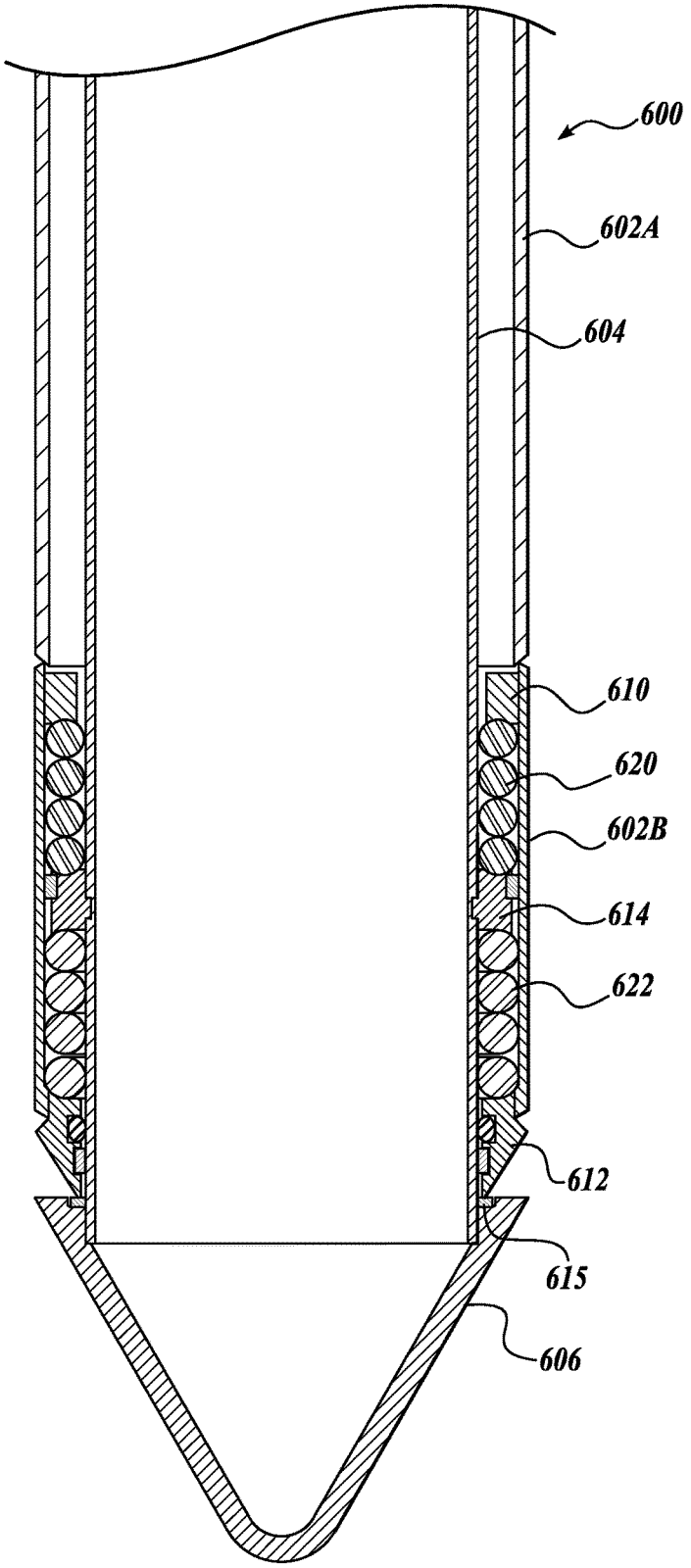
FIG. 12A is a sectional view of a lower portion of another embodiment of a pile in accordance with the present invention.
Figure 12B:
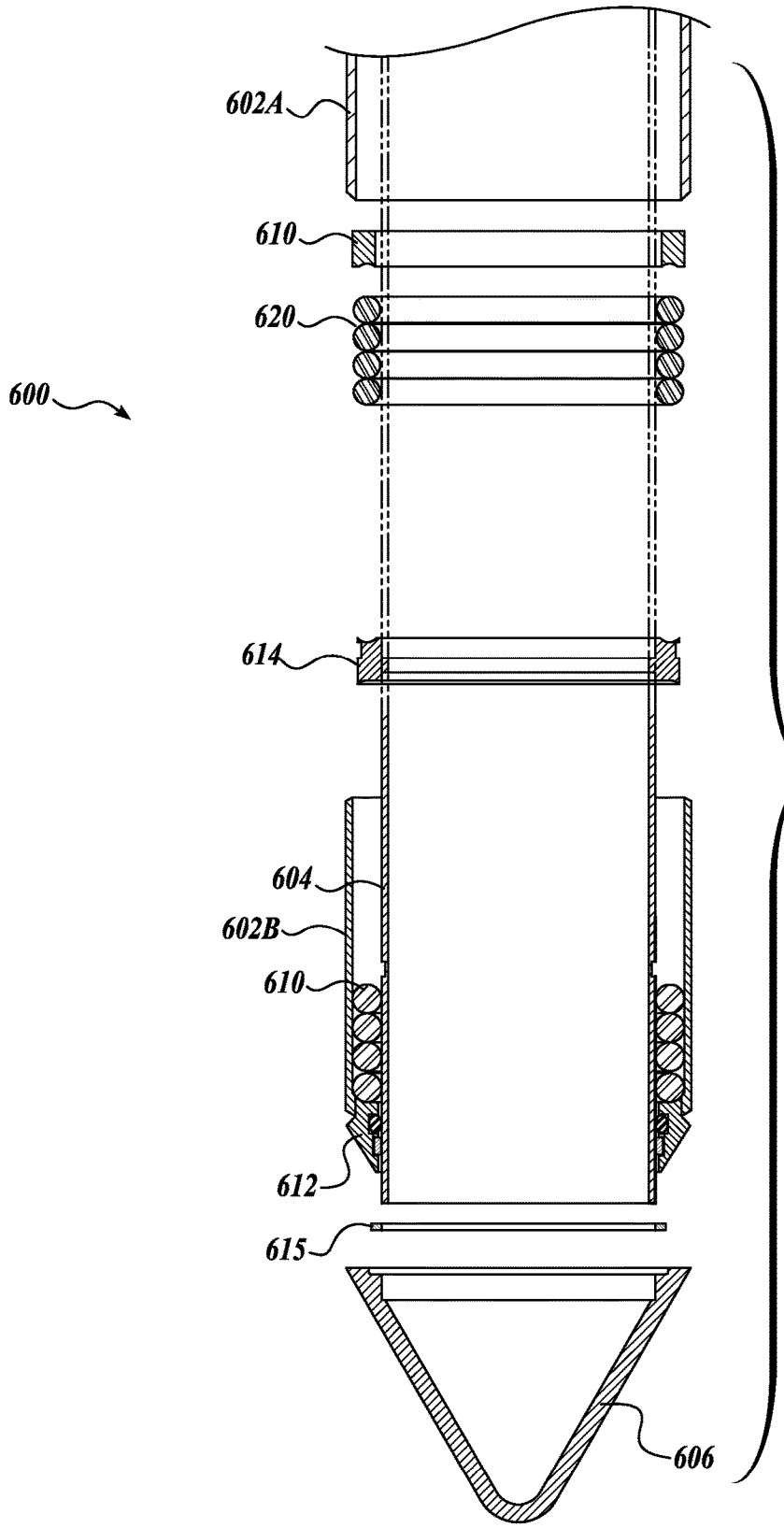
FIG. 12B is an exploded view of a slightly modified version of the pile shown in FIG. 12A.

FIG. 12A shows a sectional view of a lower portion of an embodiment of the pile 600 shown in FIG. 11, wherein the outer tube 602A, 602B (in this embodiment comprising two parts) is substantially isolated from the pile driving force, for example, the vibratory impetus from the vibratory driver 95. A partially exploded view of the pile 600 is shown in FIG. 12B. The outer tube 602B includes an upper annular retainer 610 fixedly secured to an inner wall of the outer tube 602B at a selected axial location, and a lower annular retainer 612 fixedly secured to the inner wall of the outer tube 602B, at or near the shoe-end of the outer tube 602B. An intermediate annular retainer 614 is fixedly attached to the outer wall of the inner member 604, between the upper and lower annular retainers 610, 612. An upper spring 620, is retained by and between the upper annular retainer 610 and the intermediate annular retainer 614. A lower spring 622 is retained by and between the intermediate annular retainer 614 and the lower annular retainer 612.

In this configuration, the outer tube 602A, 602B is substantially isolated from downward and upward high frequency impulses applied to the inner member 604, for example, with a vibratory driver 95. As used herein, and consistent with conventional vibratory drivers, high frequency vibrations is defined to mean vibrations of 20 Hz or higher. In particular, the intermediate retainer 614, which is fixed to the inner member 604, compresses the lower spring 622 on the downward impulses and the upper spring 620 on the upward impulses. Preferably, an annular elastic member 615 is disposed between the lower retaining member 612 and the shoe 606. Therefore, the outer tube 602B sees the driver 95 force through the springs 620, 622, decreasing the rise time of the impulses. Sound transmitted by the outer tube 602B is proportional to the rise time in force.

Figure 13:
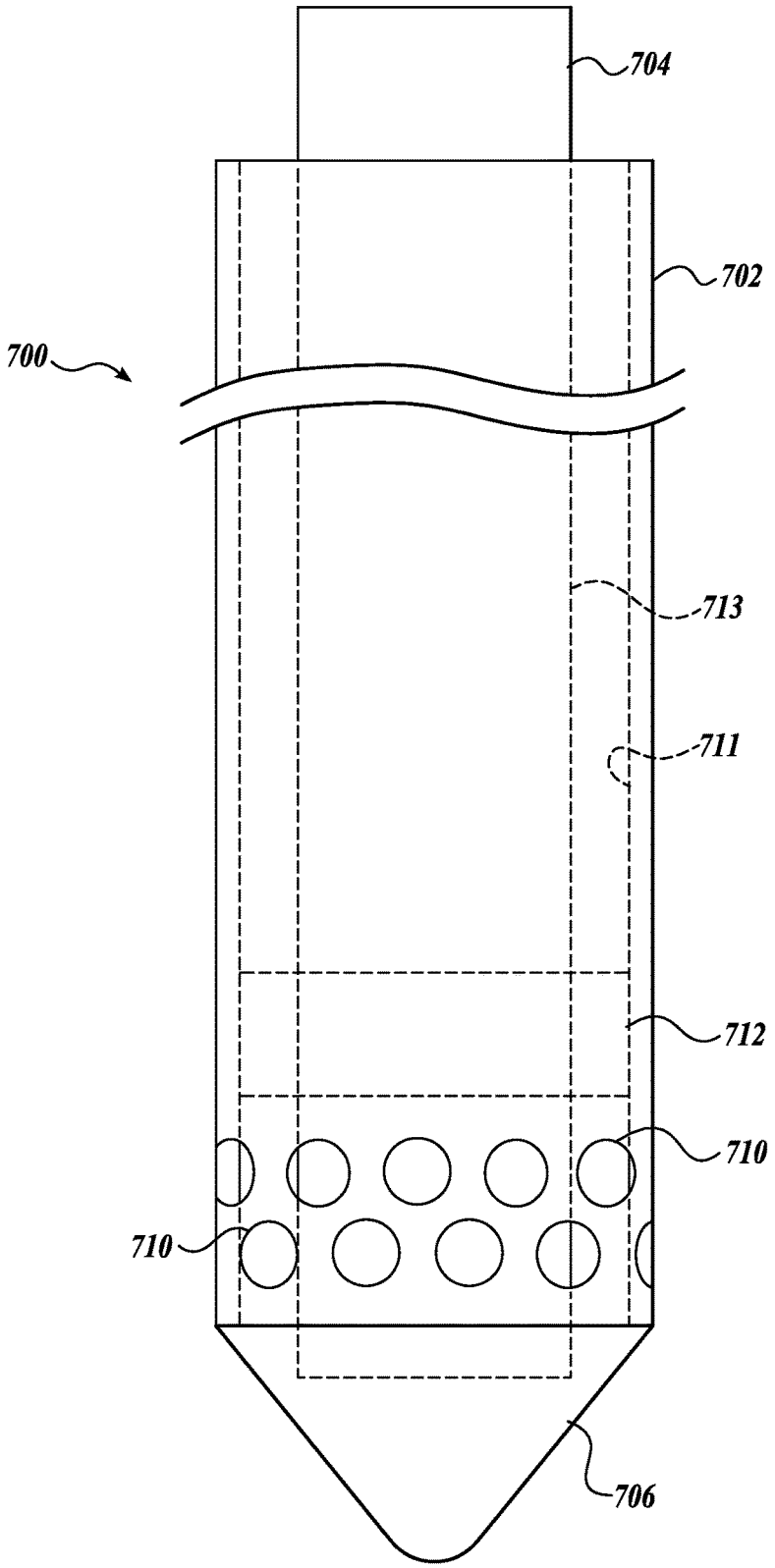
FIG. 13 is a front view of another embodiment of a pile in accordance with the present invention having apertures on a lower portion of the outer tube, and a shear spring/seal.

FIG. 13 shows a pile 700 similar to pile 600 shown in FIG. 12A. In this embodiment, the outer tube 702 includes a plurality of apertures 710 near a lower end of the outer tube 702. Two rows of offset circular apertures are shown in FIG. 13. Preferably, an annular seal 712 is provided in the annular channel between the outer tube 702 and the inner member 704 above the plurality of apertures 710, to prevent water or other foreign matter from entering the upper portion of the annular channel. The plurality of apertures 710 increase the elasticity of the lower portion of the outer tube 702, forming a natural spring. Unlike conventional piles, the outer tube 702 of pile 700 is pulled into the sediment by the shoe 706, which is driven into the sediment by a pile impact driver or vibrational driver impacting or vibrating the inner member 704.

The annular seal 712 may be formed from an elastic material that is affixed to an inner surface 711 of the outer tube 702 and to an outer surface 713 of the inner member 704, thereby elastically connecting the outer tube 702 and the inner member 704. The annular seal 712 will act as a shear spring therebetween, further vibrationally isolating the outer tube 702 from the inner member 704.

It will be appreciated that more or fewer rows of apertures may be provided, and selecting a size, shape, and number of apertures to accommodate a particular application is believed to be well within the skill in the art. It is contemplated that apertures that are elongate in the circumferential direction may be desirable to provide improved elastic characteristics during driving.

Persons of skill in the art will appreciate that the characteristics of the various pile embodiments disclosed herein may be combined. For example, it is expressly contemplated that the inner members may be configured to be removed after driving in the piles. For example, in the embodiments shown in FIGS. 12A and 12B, the inner member 602 may comprise two axially aligned and separable segments, such that the upper segment can be removed after the pile is installed.

While illustrative embodiments have been illustrated and described, it will be appreciated that various changes can be made therein without departing from the spirit and scope of the invention.

The embodiments of the invention in which an exclusive property or privilege is claimed are defined as follows:

1. A pile configured for noise abatement during driving into the ground, the pile comprising:

a pile driving shoe;

an outer tube elastically connected to the driving shoe, wherein the elastic connection substantially isolates the outer tube from high frequency vibration of the driving shoe;

an inner member that extends through the outer tube and engages the driving shoe defining an annular channel between the inner member and the outer tube, wherein the inner member extends upwardly from the outer tube; and an annular seal disposed near a lower end of the annular channel, wherein the pile is configured to be driven into the ground by a pile driver that engages the inner member without engaging the outer tube.

2. The pile of claim 1, wherein the inner member is configured to be removed after the pile is driven into the ground.

3. The pile of claim 1, wherein the inner member comprises a tube that is configured to clamp to a vibratory driver without the vibratory driver engaging the outer tube.

4. The pile of claim 1, wherein the outer tube is pulled into the ground by the driving shoe during driving.

5. The pile of claim 1, wherein a proximal end of the outer tube is connected to the driving shoe with one or more of an annular elastic member and a compression spring.

6. The pile of claim 1, wherein a proximal portion of the outer tube is connected to the driving shoe, wherein the proximal portion of the outer tube comprises a plurality of apertures.

7. The pile of claim 6, further comprising an annular seal that seals the annular channel above the plurality of apertures.

8. The pile of claim 7, wherein the annular seal comprises an inflatable bladder.

9. The pile of claim 8, wherein the inflatable bladder is configured to be inflated with water.

10. The pile of claim 1, wherein the annular channel is substantially filled with a compressible material.

11. The pile of claim 10, wherein the compressible material comprises air or a polymeric foam.

12. The pile of claim 1, wherein one of the outer tube and the inner member further comprises a lower retainer and an upper retainer that extend into the annular channel, and the other of the outer tube and the inner member further comprises an intermediate retainer that extends into the annular channel and is located between the lower retainer and the upper retainer, and further comprising a first spring disposed between the upper retainer and the intermediate retainer, and a second spring disposed between the intermediate retainer and the lower retainer.

13. The pile of claim 12 wherein the first and second springs comprise compression springs.

14. The pile of claim 1, further comprising an annular shear spring disposed between the outer tube and the inner member.

* * * * *